US005860481A

United States Patent [19]

Prokop et al.

[11] Patent Number: 5,860,481

[45] Date of Patent: Jan. 19, 1999

[54] FLUID-OPERATED STRIKER ASSEMBLY WITH AUTOMATIC STROKE LENGTH VARIATION

[75] Inventors: Heinz-Jürgen Prokop, Essen; Karlheinz Fritz, Sprockhövel; Marcus Geimer, Essen, all of Germany

[73] Assignee: Krupp Bautechnik GmbH, Essen, Germany

[21] Appl. No.: 921,113

[22] Filed: Aug. 29, 1997

[30] Foreign Application Priority Data

Sep. 10, 1996 [DE] Germany ..... 196 36 659.3

[51] Int. Cl.[6] ..... B25D 16/00

[52] U.S. Cl. ..... 173/207; 173/17

[58] Field of Search ..... 173/13, 15, 17, 173/19, 128, 207, 208, 206

[56] References Cited

U.S. PATENT DOCUMENTS

| | | | |
|---|---|---|---|
| 2,619,072 | 11/1952 | Clarks et al. . | |
| 3,669,197 | 6/1972 | Hanson et al. | 173/19 |
| 3,880,244 | 4/1975 | Boom et al. | 173/19 |
| 3,995,700 | 12/1976 | Mayer et al. | 173/207 |
| 4,179,983 | 12/1979 | Wallace | 173/208 |
| 4,349,075 | 9/1982 | Henriksson | 173/208 |
| 4,646,854 | 3/1987 | Arndt et al. . | |
| 4,676,323 | 6/1987 | Henriksson | 173/208 |
| 5,064,005 | 11/1991 | Krone | 173/208 |
| 5,529,132 | 6/1996 | Evarts | 173/13 |
| 5,653,295 | 8/1997 | Juvonen et al. | 173/207 |

FOREIGN PATENT DOCUMENTS

| | | |
|---|---|---|
| 31 15 361 | 10/1982 | Germany . |
| 34 43 542 | 7/1990 | Germany . |
| 42 29 590 | 3/1994 | Germany . |

*Primary Examiner*—Daniel B. Moon
*Assistant Examiner*—John Paradiso
*Attorney, Agent, or Firm*—Venable; Gabor J. Kelemen

[57] ABSTRACT

A fluid-operated striker assembly includes a working cylinder and a striker piston slidably received in the working cylinder for executing working (forward) and return strokes. The striker piston delivers a blow to a tool bit during the working stroke when the striker piston is either in a limit position or in an advanced position which is beyond the limit position in the direction of the working stroke. A control arrangement applies an alternating fluid pressure to the striker piston to execute the working and return strokes. Further, a precontrol arrangement is provided for affecting the control arrangement dependent on whether the striker piston has exceeded its limit position. The precontrol arrangement causes the control arrangement to operate the striker piston with a normal working stroke as long as the striker piston delivers a blow to the tool bit in the limit position, and causes the control arrangement to operate the striker piston with a short working stroke—whose length is less than that of the normal working stroke—as long as the striker piston delivers a blow to the tool bit in the advanced position.

15 Claims, 7 Drawing Sheets

FLUID-OPERATED STRIKER ASSEMBLY WITH AUTOMATIC STROKE LENGTH VARIATION

CROSS REFERENCE TO RELATED APPLICATION

This application claims the priority of German Application No. 196 36 659.3 filed Sep. 10, 1996, which is incorporated herein by reference.

BACKGROUND OF THE INVENTION

This invention relates to a fluid-operated striker assembly which has a striker piston movable in a working cylinder and adapted to strike a tool bit as well as a control system having a control plunger movable in a control valve. The striker piston has two piston faces of different sizes. The smaller piston face is effective in the direction of the return stroke and is continuously connected with a pressure conduit in which working pressure prevails. The larger piston face is effective in the direction of the working stroke (forward stroke) and is alternatingly connected by the control valve with the pressure conduit and with a depressurized return conduit. The control plunger has two control faces of different sizes, operating in opposite directions. The smaller control face which is effective in the direction of the return stroke position of the control plunger is continuously connected with the pressure conduit whereas the larger control face is, by means of a circumferential groove situated between the piston faces, alternatingly and only for certain periods connected with the pressure conduit and the depressurized return conduit.

A striker assembly of the above-outlined type is disclosed, for example, in German Patent No. 3,443,542 to which corresponds U.S. Pat. No. 4,646,854 issued Mar. 3, 1987. By using a particular holding or switching valve which is incorporated in the control conduit cooperating with the control system and which is alternatingly also connected with the return conduit, it is sought to be ensured that even in case of a reflection of the striking energy from the tool bit to the striker piston, such reflected energy is hydraulically regained whereby an increase of the striking frequency of the striker piston is achieved.

Fluid-operated striker assemblies, particularly hydraulic hammers, are generally used for breaking up rocks or concrete. For such an operation the kinetic energy of a striker piston is transmitted to the tool bit by delivering blows thereto by the striker piston, and the kinetic energy is converted to comminuting work at the tool bit tip. In case of relatively hard materials, only one part of the kinetic energy is converted to comminuting work, dependent upon the hardness of the material to be comminuted. The unconverted energy portion is reflected by the tool bit to the striker piston and may be used, with a suitable device, to increase the striking frequency. In contrast, in case of relatively soft materials, the striking (kinetic) energy is fully converted to comminuting work. The softer the material the greater the comminuting effect of the tool bit and the deeper the penetration of the tool bit into the material.

Processes in which the applied striking energy is higher than the energy required for the comminution are undesirable because of the resulting higher stresses on the striker assembly. The rapid adaptation of the striking energy to all operational conditions is a significant condition for a longer service life of the striker assembly and for an optimal comminution of material.

SUMMARY OF THE INVENTION

It is an object of the invention to provide an improved fluid-driven striker assembly of the above-outlined type in which the individual striking energy is reduced before the material to be comminuted is broken.

This object and others to become apparent as the specification progresses, are accomplished by the invention, according to which, briefly stated, the fluid-operated striker assembly includes a working cylinder and a striker piston slidably received in the working cylinder for executing working (forward) and return strokes. The striker piston delivers a blow to a tool bit during the working stroke when the striker piston is either in a limit position or in an advanced position which is beyond the limit position in the direction of the working stroke. A control arrangement applies an alternating fluid pressure to the striker piston to execute the working and return strokes. Further, a precontrol arrangement is provided for affecting the control arrangement dependent on whether the striker piston has exceeded its limit position. The precontrol arrangement causes the control arrangement to operate the striker piston with a normal working stroke as long as the striker piston delivers a blow to the tool bit in the limit position, and causes the control arrangement to operate the striker piston with a short working stroke—whose length is less than that of the normal working stroke—as long as the striker piston delivers a blow to the tool bit in the advanced position.

Thus, the invention provides for a suitable reaction to the properties and behavior of the material to be comminuted upon each individual strike of the striker piston. In case the tool bit penetrates into the material, the striker piston executes only a short working stroke, as a result of which the individual striking energy is small. In case the tool bit does not penetrate into the material (normal operation), the striker piston executes a large (normal) working stroke so that the individual striking energy has a maximum value.

According to an advantageous feature of the invention, the precontrol arrangement includes a precontrol valve which is provided with a resetting arrangement and which, driven by a force directed opposite to the resetting effect, is moved from its open position into a closed position. In the open position a connection is maintained between an additional conduit and a short-stroke conduit; such a connection is interrupted in the closed position. The setting force working opposite the resetting force is generated by charging that setting face of the precontrol valve with the working pressure periodically prevailing in a precontrol conduit which is effective in the direction of the closed position.

According to a further feature of the invention, the larger plunger face of the control plunger communicates with a switch-over conduit whose outlet in the cylinder chamber of the working cylinder is situated in the region of the depressurized circumferential groove (between two lands of the striker piston) in case the striker piston assumes the normal striking position. Accordingly, at that moment only the smaller plunger face is effective in the direction of the return-stroke position of the control plunger. Further, the precontrol conduit is connected with the cylinder chamber of the working cylinder via an outlet which is situated behind the outlet of the switch-over conduit as viewed in the direction of the working stroke of the striker piston. By virtue of the mutual arrangement of the two conduit outlets in the normal operation (that is, as long as the tool bit does not penetrate into the material to be comminuted), during the working stroke of the striker piston only the outlet of the switch-over conduit is open and thus the circumferential groove of the striker piston establishes communication with the depressurized return conduit. Based on the pressure drop in the switch-over conduit, the control plunger moves into the return-stroke position under the effect of the resetting force applied to its smaller plunger face.

In case the tool bit penetrates into the material to be comminuted and thus the striker piston moves beyond the normal position (limit position) in the direction of the working stroke, the outlet of the precontrol conduit is also opened and is depressurized via the circumferential groove of the striker piston. Accordingly, the precontrol valve is shifted by the return force from its closed position into its open position.

According to a preferred embodiment of the invention, the precontrol valve has a setting face effective in the direction of its open position. This setting face which is charged with the working pressure from the pressure conduit is smaller than the setting face effective in the direction of the closed position of the precontrol valve. In such an arrangement the precontrol valve is thus provided with a purely hydraulically operating resetting arrangement.

As an alternative, a mechanically operating resetting element may be connected parallel with the smaller setting face of the precontrol valve; the resulting total resetting force is smaller than the counterforce derived from the pressurization of the larger setting face. It is a result of such a combined mechanical/hydraulic resetting arrangement that in each instance upon starting, the striker assembly first operates in the short-stroke mode.

It is also feasible according to the invention to provide a purely mechanical arrangement to effect resetting.

It is to be understood that the setting face of the precontrol valve effective in the closing direction also may have a mechanical element (such as a spring) for supporting the switch-over process. In such a case, in each instance upon starting, the striker assembly first operates in the long-stroke (normal-stroke) mode.

According to a further feature of the invention, a precontrol branch conduit extends from the precontrol conduit and, separated from the additional conduit, is connected to an output of the precontrol valve and is charged with the working pressure in the closed position of the precontrol valve. In the absence of particular circumstances or geometrical conditions, the precontrol branch conduit is provided with a flow restrictor, preferably a throttle.

In the simplest case a hydraulic resetting of the precontrol valve is effected by providing that its smaller setting face is charged with the working pressure from the pressure conduit by means of a precontrol resetting conduit and a precontrol pressure conduit.

According to a further advantageous feature of the invention, the precontrol pressure conduit is at the input side coupled to the precontrol valve in such a manner that in the closed position of the latter the precontrol pressure conduit is connected with the precontrol branch conduit. In this manner the precontrol valve is moved or, as the case may be, is maintained firmly in its closed position by the pressurization of its larger setting face as long as the precontrol conduit connected with the precontrol branch conduit is not open and thus depressurized.

According to another advantageous feature of the invention the precontrol valve is structured such that in its open position the short-stroke conduit is simultaneously connected with the additional conduit and the precontrol branch conduit. In this manner the pressure conditions in the three interconnected conduits may be mutually affected and adapted to one another. This applies particularly for the pressure conditions in the additional conduit and in the precontrol branch conduit as well as in the precontrol conduit in case the short-stroke conduit is blocked periodically during the working stroke of the striker piston. It is a result of the above-described interconnection that the precontrol branch conduit always remains depressurized in the open position of the precontrol valve, because the control conduit too, is depressurized and therefore the precontrol valve is maintained in its open position.

According to yet another advantageous feature of the invention, the short-stroke conduit is connected with the cylinder chamber of the working cylinder by an outlet which—as viewed in the direction of the working stroke—is situated behind the outlet of the pre-control conduit. It is a result of such an arrangement that during the return stroke motion of the striker piston the latter first opens the short-stroke conduit and is thus exposed to working pressure and simultaneously the precontrol conduit is exposed to pressure with the result that the precontrol valve—at an early moment after a short stroke—is moved into its closed position. In the same manner the control valve switches over to the working stroke position.

Departing from the previously outlined arrangement (where a precontrol branch conduit and an additional conduit are attached to the precontrol valve at its output side), the precontrol valve, at the output side, may be additionally connected by means of a switching conduit to the alternating pressure conduit for the rearward cylinder chamber portion. In such an arrangement in the closed position only a connection between the precontrol pressure conduit and the precontrol branch conduit exists, while the short-stroke conduit, the additional conduit and the switching conduits are closed by the precontrol valve. In the open position, on the one hand, the precontrol branch conduit and the switching conduit and, on the other hand, the short-stroke conduit as well as the additional conduit are connected with one another via the precontrol valve while the precontrol pressure conduit is closed. It is a result of such an arrangement that the precontrol valve may at all times switch over to the closed position only after the control plunger has assumed its working-stroke position and accordingly, in the alternating pressure conduit for the rearward cylinder chamber portion a pressure prevails which also affects the precontrol branch conduit and the precontrol conduit by means of the switching conduit.

Departing from the earlier-described embodiments, the short-stroke conduit exposed to the working pressure is connected to the input of the precontrol valve with the interposition of a pressure controlled timing unit which is switched to its inoperative position as long as the working pressure prevails in the alternating pressure conduit connected with the rear cylinder chamber portion.

The timing unit has a pressure sensor, a timing member controlled by the pressure sensor and a shut-off valve controlled by the timing member. The pressure sensor converts the working pressure prevailing in the precontrol conduit into a control signal and dependent on the signal magnitude, sets a time period during which the shut-off valve assumes its open position. It is an advantage of such an arrangement that the magnitude of the "short stroke" about to be triggered may be varied and may also be externally (manually or by remote control) affected by an appropriate setting of the timing member. It is essentially a desideratum that upon a dropping of the working pressure the timing member reduces the period for the open position of the shut-off valve. The resetting of the timing unit is made possible by connecting it via a timing conduit with the alternating pressure conduit.

DESCRIPTION OF THE PREFERRED EMBODIMENTS

The striker assembly generally designated at 1 in FIGS. 1–5 has a working cylinder 2 receiving a striker position 3 for axial reciprocation therein. The striker piston 3 has two lands 3*a* and 3*b* separated from one another by a circumferential groove 3*c*. The piston faces A1 and A2 which are radial annular surface parts of the lands 3*b* and 3*a*, respectively, and which are oriented axially outwardly, that is, away from the circumferential groove 3*c*, bound a rearward and a frontal cylinder chamber portion 2*a* and 2*b*, respectively. The piston face A1 has an area which is less than that of the piston face A2.

Externally of the working cylinder 2 the striker piston 3 has a downstepped striker tip 3*d* which cooperates with a rearward terminal radial shank face of a tool bit, such as a chisel 4. The motion of the striker piston 3 in the direction of the working stroke (forward stroke) is designated by an arrow 3*e*.

Figure 1:
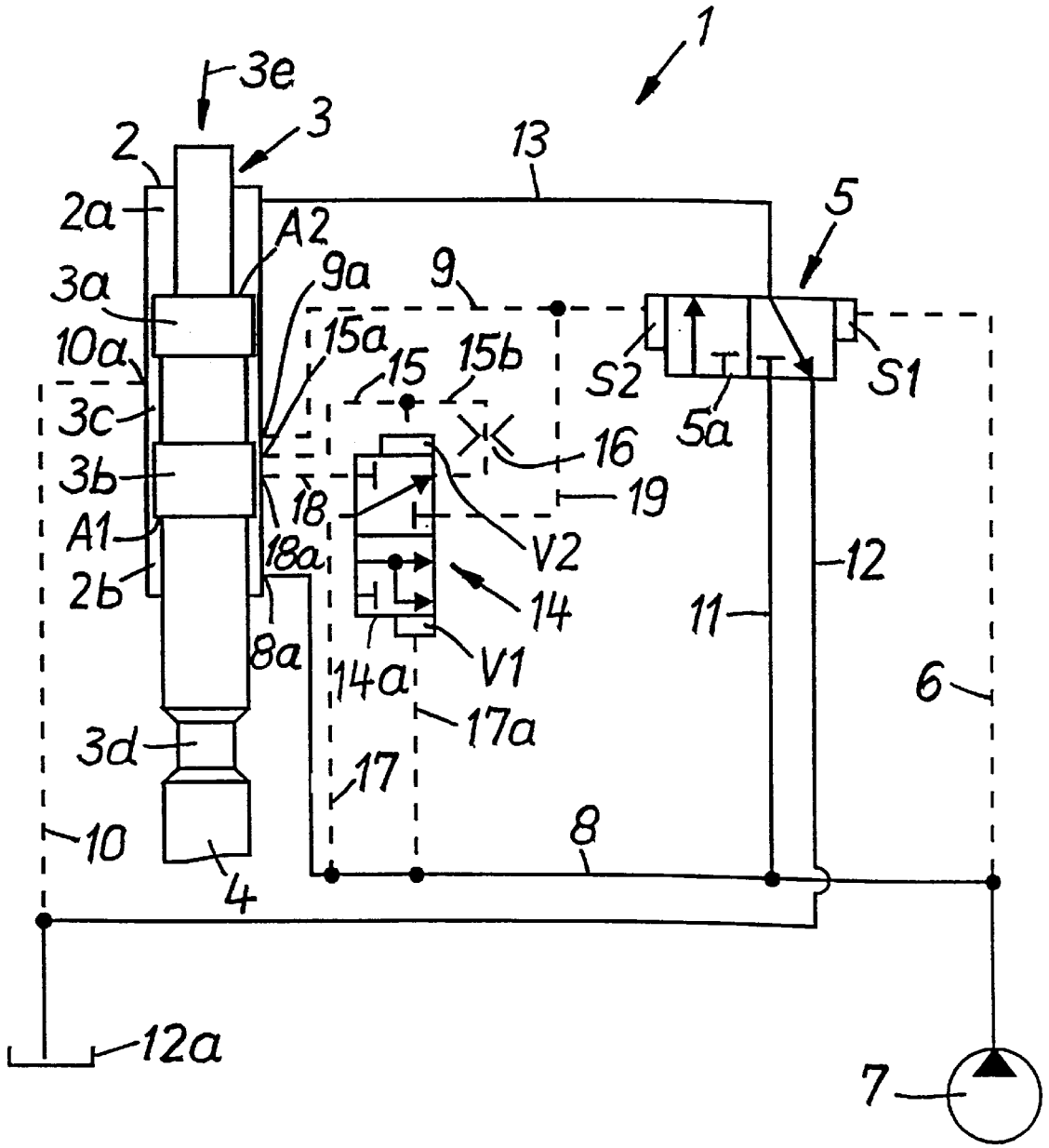
FIG. 1 is a hydraulic circuit diagram of a striker assembly according to a preferred embodiment of the invention, in which the precontrol valve is reset by hydraulic means.

FIG. 1 (similarly to FIGS. 2–5) shows the striker assembly in a state immediately following the impacting of the chisel 4 by the striker piston 3. A normal operation is assumed, that is, the chisel 4 does not penetrate into the material to be comminuted and thus the striker piston 3 assumes a normal, predetermined impacting position.

The control arrangement for a switch-over of the motion of the striker piston 3 includes a control plunger 5*a* movable within a control valve 5. The smaller plunger face S1 is continuously exposed to the working pressure (that is, the system pressure) by means of a resetting conduit 6. The system pressure is generated by an energy source, such as a hydraulic pump 7. The smaller piston face A1 too, is continuously exposed to the working pressure by means of a pressure conduit 8 which communicates with the resetting conduit 6. The outlet 8*a* of the pressure conduit 8 is arranged relative to the working cylinder 2 such that it is situated at all times externally of the piston land 3*b* and thus is always positioned in the frontal cylinder chamber portion 2*b*.

The larger plunger face S2 of the control plunger 5*a* is coupled by means of a switch-over conduit 9 with the working cylinder 2 such that its outlet 9*a* is, in the shown operational state, coupled to a depressurized return conduit 10 via the circumferential groove 3*c*. The outlet 9*a* of the switch-over conduit 9 and the outlet 10*a* of the return conduit 10 are thus situated at a distance from one another (measured in the axial direction of the striker piston 3) which is less than the axial length of the circumferential groove 3*c*.

The control valve 5 is connected, on the one hand, by a control conduit 11 to the pressure conduit 8 and, on the other hand, via a return conduit 12 to the sump 12*a* in which the return conduit 10 also terminates. Further, the control valve 5 is connected to the rearward cylinder chamber portion 2*a* by means of an alternating-pressure conduit 13. The larger piston face A2 is adapted to be exposed to the working pressure (system pressure) that can be supplied to the cylinder chamber portion 2*a* by the alternating-pressure conduit 13.

The control valve 5 may assume two valve positions, namely, the illustrated (right-hand) return-stroke position in which the larger piston face A2 is depressurized via the alternating-pressure conduit 13 and the return conduit 12 and the (left-hand) working-stroke position in which the rearward cylinder chamber portion 2*a* is charged with the working pressure by means of the pressure conduit 8, the control conduit 11 connected to the pressure conduit 8 and the alternating-pressure conduit 13. As a result of such an operational state, the striker piston 3 executes a working stroke in the direction of the arrow 3*e* against the resetting force with which the smaller piston face A1 is charged.

According to the invention the striker assembly 1 further has a precontrol arrangement including a precontrol valve 14 which may assume either the illustrated (upper) closed position or a (lower) open position.

The position of the pre-control valve 14 is determined by the pressures applied to two faces of the plunger 14*a* of the pre-control valve 14, namely, the smaller setting face V1 and the larger setting face V2. The setting face V2 is coupled via a precontrol conduit 15 with the cylinder chamber of the cylinder 2. The outlet 15*a* of the precontrol conduit 15 is situated behind the outlet 9*a* of the control conduit 9 as viewed in the direction of the working stroke (arrow 3*e*). The precontrol conduit 15 is connected by means of a precontrol branch conduit 15*b* to the output side of the precontrol valve 14. The precontrol branch conduit 15*b* contains a throttle 16.

The smaller setting face V1 of the plunger 14*a* is connected to the pressure conduit 8 via a precontrol resetting conduit 17*a* and is thus continuously exposed to the working pressure. The precontrol valve 14 seeks to assume its open position under the effect of the resetting force exerted on the setting face V1.

At its input side the precontrol valve 14 is connected, on the one hand, to the cylinder chamber of the working cylinder 2 by means of a short-stroke conduit 18 having an outlet 18*a* and, on the other hand, to the pressure conduit 8 by means of a precontrol-pressure conduit 17. The outlet 18*a* of the short-stroke conduit 18 is located behind the outlet 15*a* of the precontrol conduit 15 as viewed in the direction of the working stroke (arrow 3*e*). At the output side the pre-control valve 14 is connected (as noted earlier), on the one hand, to the precontrol conduit 15 by means of the precontrol-branch off conduit 15*b* and, on the other hand, to the switch-over control conduit 9 for the control valve 5 by means of an additional conduit 19.

As illustrated, in the (upper) closed position of the pre-control valve 14 the precontrol pressure conduit 17 is connected with the precontrol conduit 15 by means of the precontrol-branch conduit 15*b* and in this manner—by virtue of its larger setting face V2—a setting force in the direction of the closed position is generated. Further, in the illustrated closed position the short-stroke conduit 18 and the additional conduit 19 are shut off in the direction of the pre-control valve 14.

In the (lower) open position of the precontrol valve 14 the short-stroke conduit 18 is simultaneously connected with the precontrol-branch conduit 15*b* and the additional conduit 19 while the precontrol-pressure conduit 17 is blocked. Dependent upon the position of the striker piston 3 relative to the outlet 18*a* of the short-stroke conduit 18, either the pressure conditions in the conduits 15, 15*b*, 19 and 18 or only the pressure conditions in the conduits 15, 15*b* and 19 are adapted to one another. The latter is the case if—as illustrated—the outlet 18*a* of the short-stroke conduit 18 is closed towards the cylinder chamber of the working cylinder 2 by the land 3*b* of the striker piston 3.

In the description which follows, the normal operation (long-stroke operation) of the striker assembly according to the invention will be set forth.

After switching over the control valve 5 into the (left-hand) working-stroke position, the motion of the striker piston 3 is initiated in the direction of the working stroke (arrow 3*e*) after having reached its upper point of reversal (upper dead center). The precontrol valve 14 assumes its illustrated closed position and is maintained in such a closed position by the pressure communicated thereto by the precontrol pressure conduit 17 (since working pressure is applied to both setting faces V1 and V2 of the precontrol valve 14)

When the striker piston 3 impacts upon the chisel 4, the switch-over control conduit 9 is depressurized via the circumferential groove 3*c* and the return conduit 10, as result of which the control plunger 5*a* of the control valve 5 switches over to the illustrated return-stroke position under the effect of the return force derived from the smaller control surface S1 and thus initiates the return stroke of the striker piston 3. In case the chisel 4 does not penetrate into the material to be comminuted, the striker piston 3 does not leave its intended, normal impacting plane where it hits the shank end of the chisel 4, so that the outlet 15*a* of the precontrol conduit 15 remains closed by the land 3*b*. The striker piston 3 executes its return stroke as long as the additional conduit 9 is coupled, through its outlet 9*a*, with the pressure conduit 8 via the frontal cylinder chamber portion 2*b*. Accordingly, to the larger control face S2 the working pressure is applied whereby the control plunger 5*a* is moved into the (left-hand) working-stroke position in which it connects the rearward cylinder chamber portion 2*a* with the pressure conduit 8 via the control conduit 11 and thus initiates a new working stroke.

If during operation of the striker assembly the position of the impacting plane between the striker piston 3 and the chisel 4 shifts in the direction of the working stroke (that is, the chisel penetrates into the material to be comminuted) the following operational processes take place:

After switching over the control valve 5 into the working stroke position and the precontrol valve 14 into the closed position, the striker piston 3 first executes a working stroke. If during execution of such a working stroke the chisel 4 penetrates into the material to be comminuted, the striker piston 3 leaves its normal impacting plane and follows the chisel 4, thus assuming an "advanced" position. As a result of such a shift, the outlet 15*a* of the precontrol conduit 15 which is initially closed by the piston land 3*b*, is opened and is depressurized by virtue of the hydraulic connection established via the annular groove 3*c* and the return conduit 10. Accordingly, the precontrol valve 14 switches over from its closed position to the open position, whereby the short-stroke conduit 18 is coupled to the additional conduit 19 which, in turn, is depressurized via the switch-over conduit 9, the annular groove 3*c* and the return conduit 10. By virtue of such a depressurization the control valve 5 too, has switched into the return stroke position whereby the striker piston 3 executes its return stroke.

Upon executing a smaller-than-normal stroke, also referred to as the "short stroke", the outlet 18*a* of the short-stroke conduit 18 is opened and is coupled with the pressure conduit 8 via the frontal cylinder chamber portion 2*b*. By means of the short-stroke conduit 18 which is thus exposed to working pressure, the conduits 15*b* and 15 and also the conduits 19 and 9 are exposed to pressure with the intermediary of the precontrol valve 14, as a result of which the control valve 5 is, prior to reaching the maximum possible stroke, switched over into the (left-hand) working-stroke position and again, a working stroke is initiated. At the same time, as a result of exposing the larger setting face V2 of the precontrol valve 14 to the working pressure, the precontrol valve 14 is caused to move into the illustrated closed position against the return force exerted on the smaller setting face V1.

The arrangement according to the invention thus makes it possible for the striker assembly to react, upon each individual blow of the striker piston 3 to the chisel 4, to the properties or behavior of the material to be comminuted. In case the tool bit penetrates into the material to be comminuted, the striker piston executes only a short stroke so that the individual striking energy is low. In case the tool bit does not penetrate into the material to be comminuted, a larger stroke (normal stroke) is executed with a correspondingly maximum individual striking energy.

Figure 2:
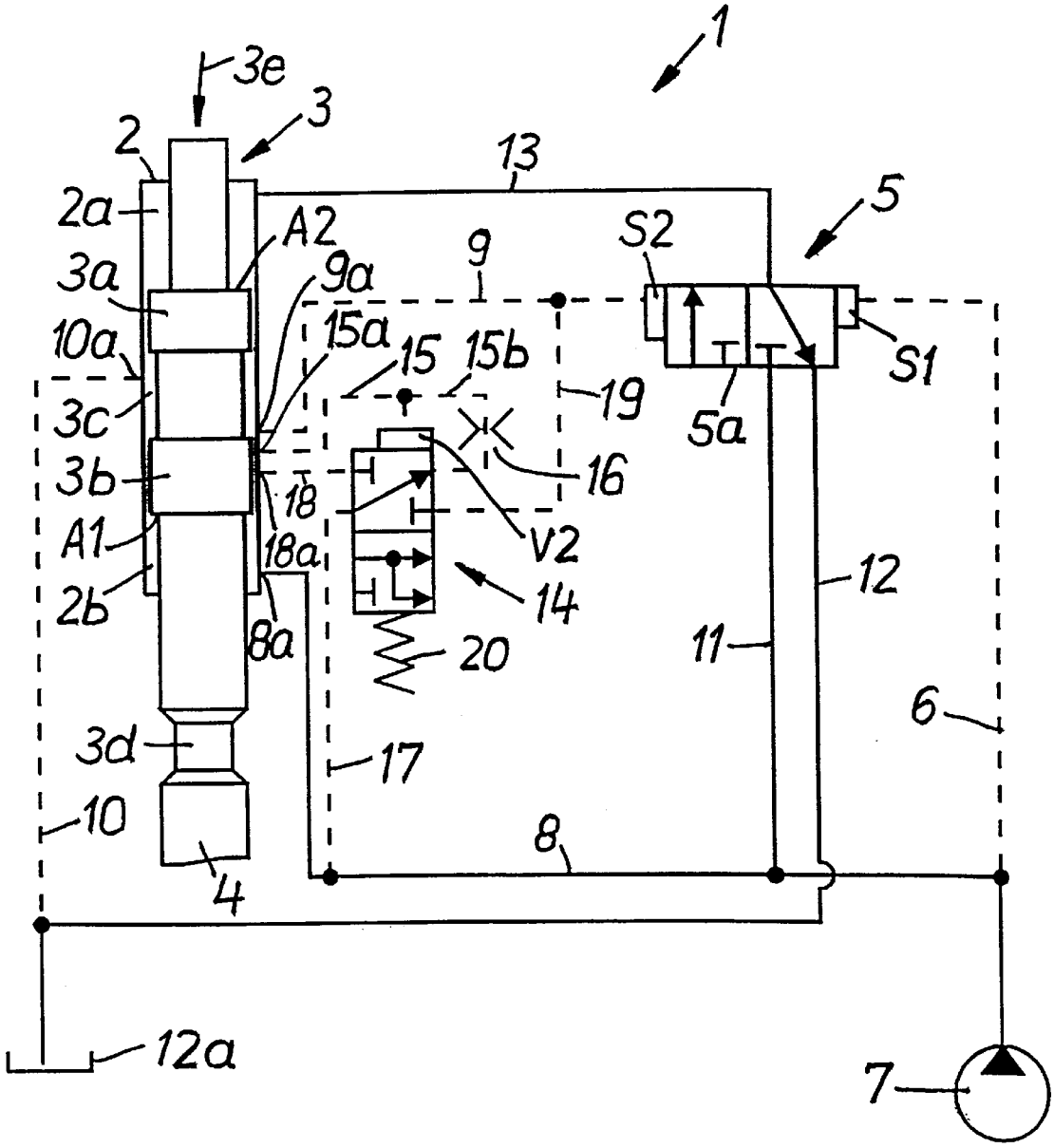
FIG. 2 is a hydraulic circuit diagram of a striker assembly according to another preferred embodiment of the invention, in which the precontrol valve is reset by mechanical means.

In the embodiment according to FIG. 2, the precontrol valve 14 has a purely mechanical resetting arrangement formed of a spring element 20. Accordingly, in such an embodiment neither a pressurizable setting face V1 nor a precontrol return conduit 17*a* of the earlier-described embodiment are present.

Figure 3:
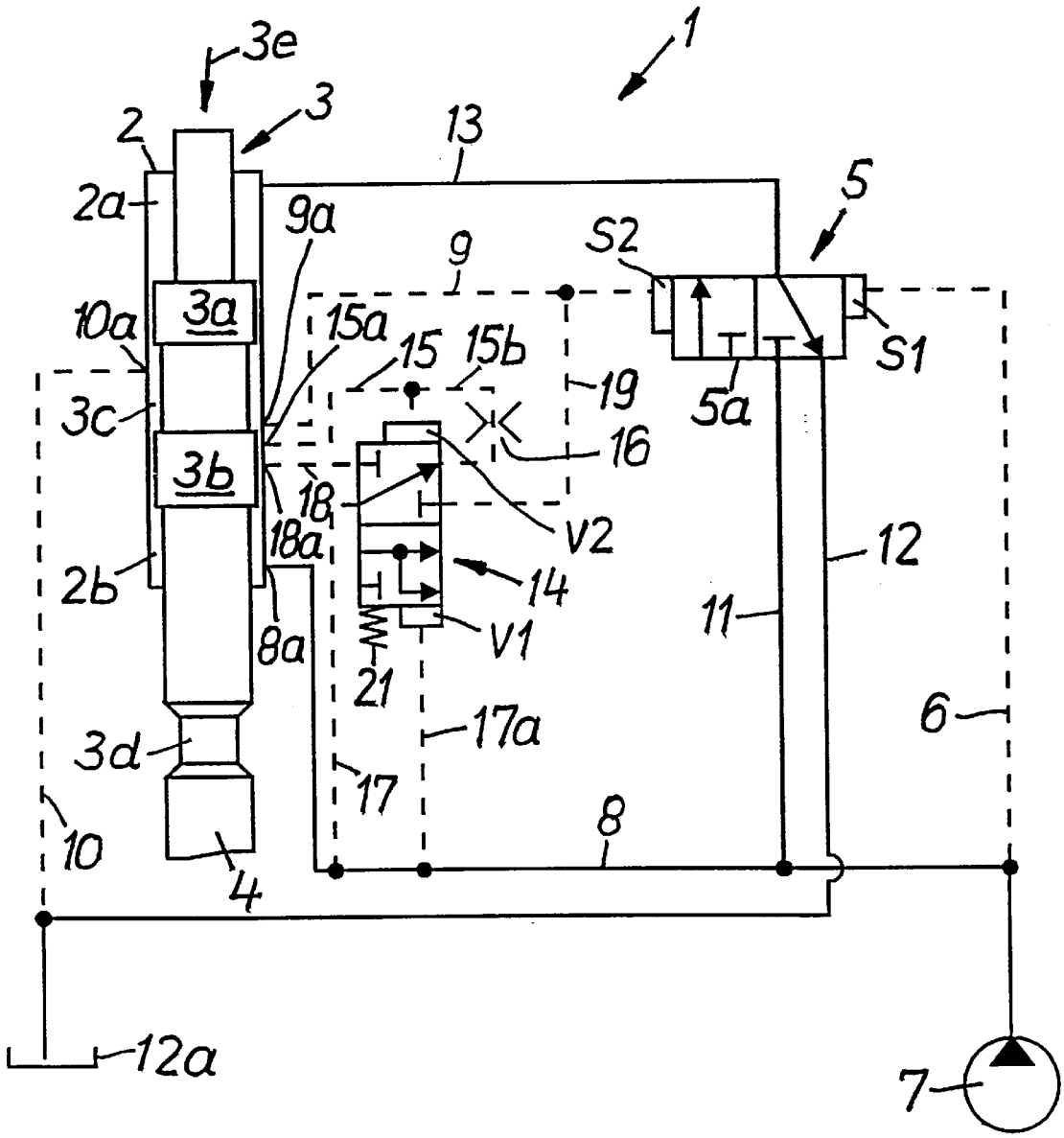
FIG. 3 is a hydraulic circuit diagram of a striker assembly according to a further preferred embodiment of the invention, in which the precontrol valve is reset by combined hydraulic/mechanical means.

In the embodiment according to FIG. 3 the precontrol valve 14 is provided with a combined mechanical/hydraulic resetting arrangement. For this purpose, a mechanical resetting element, such as a spring 21 is connected in parallel with the smaller setting face V1 which is coupled to the pressure conduit 8 by means of the precontrol return conduit 17*a*. The total resetting force generated by means of the force derived from the setting face V1 and the spring 21 is less than the counterforce derived from the larger setting face V2 when the latter is charged with pressure. By virtue of the spring 21 the precontrol valve 14 assumes its open position when the striker assembly is switched off and therefore the striker piston 3 initially always operates in the short-stroke mode.

In contrast to the embodiments described before, the embodiment according to FIG. 4 has a precontrol valve 14 which has two coupling ports at its input side and three coupling ports at its output side. In addition, the precontrol valve 14 is, at its output side, connected by a switching conduit 22 with the alternating-pressure conduit 13. Thus, the precontrol valve 14 is designed such that in the illustrated (upper) closed position only a connection between the precontrol pressure conduit 17 and the precontrol branch conduit 15*b* to the precontrol conduit 15 is present, while at the input side the short-stroke conduit 15 and at the output side the additional conduit 19 as well as the switching conduit 22 are closed. In the (lower) open position, the switching conduit 22 is connected to the precontrol branch conduit 15*b* and the short-stroke conduit 18 is connected to the additional conduit 19. The precontrol pressure conduit 17 is closed at the input side of the precontrol valve 14.

Figure 4:
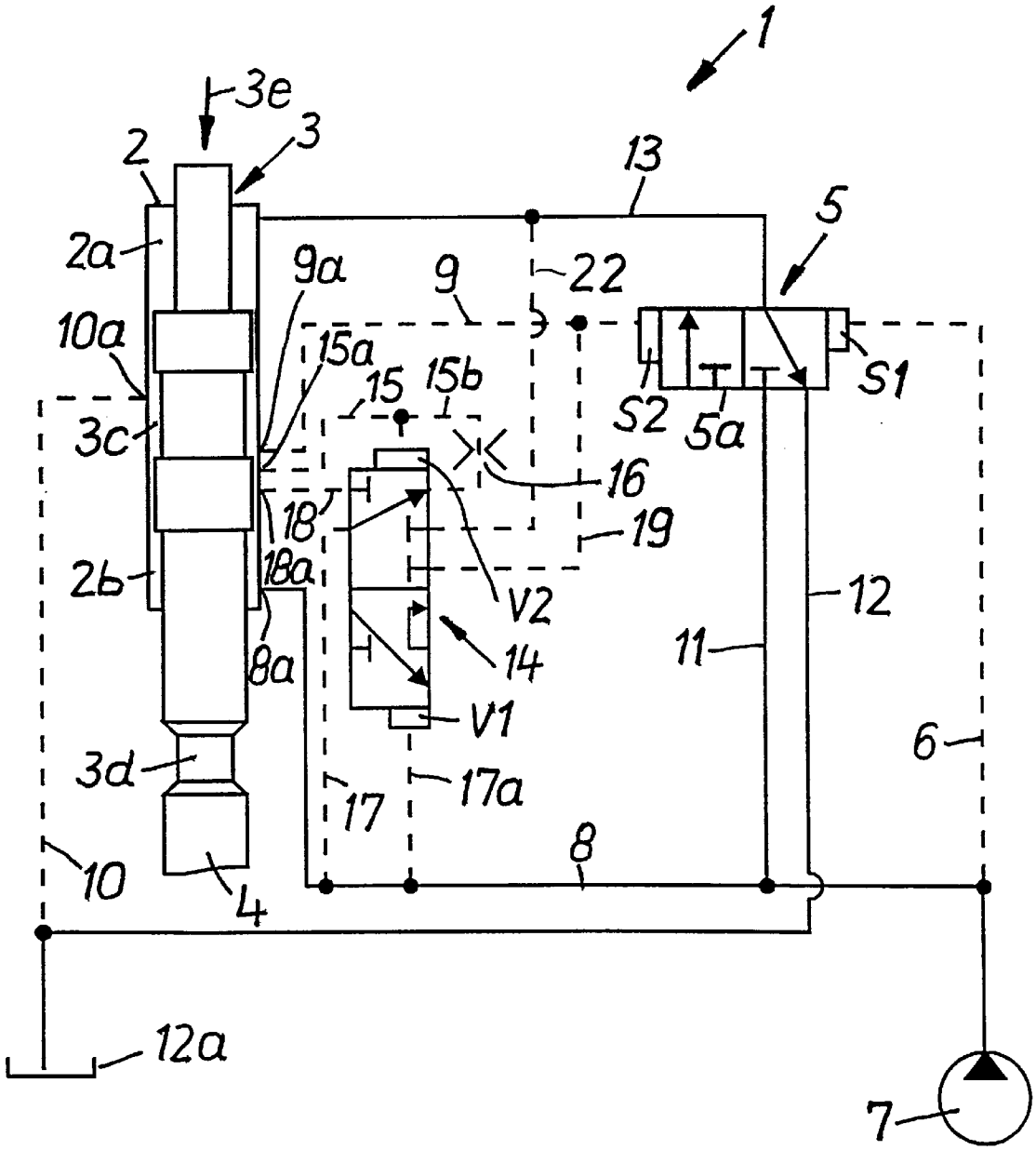
FIG. 4 is a hydraulic circuit diagram of a striker assembly according to yet another preferred embodiment of the invention, in which the precontrol valve is structured and switched differently from the embodiments of FIGS. 1, 2 and 3.

As a result of the design and outlay of the precontrol valve 14 according to the FIG. 4 embodiment, switching from the open position into the closed position is triggered only after the control valve 5 has reached its working-stroke position and accordingly, the alternating pressure conduit 13 is charged with working pressure. By means of the switching conduit 22 in which then too, working pressure prevails, the precontrol branch conduit 15*b* is pressurized, and, as a result, under the effect of the larger setting face V2, a switch-over of the precontrol valve 14 into the closed position is triggered.

Figure 5:
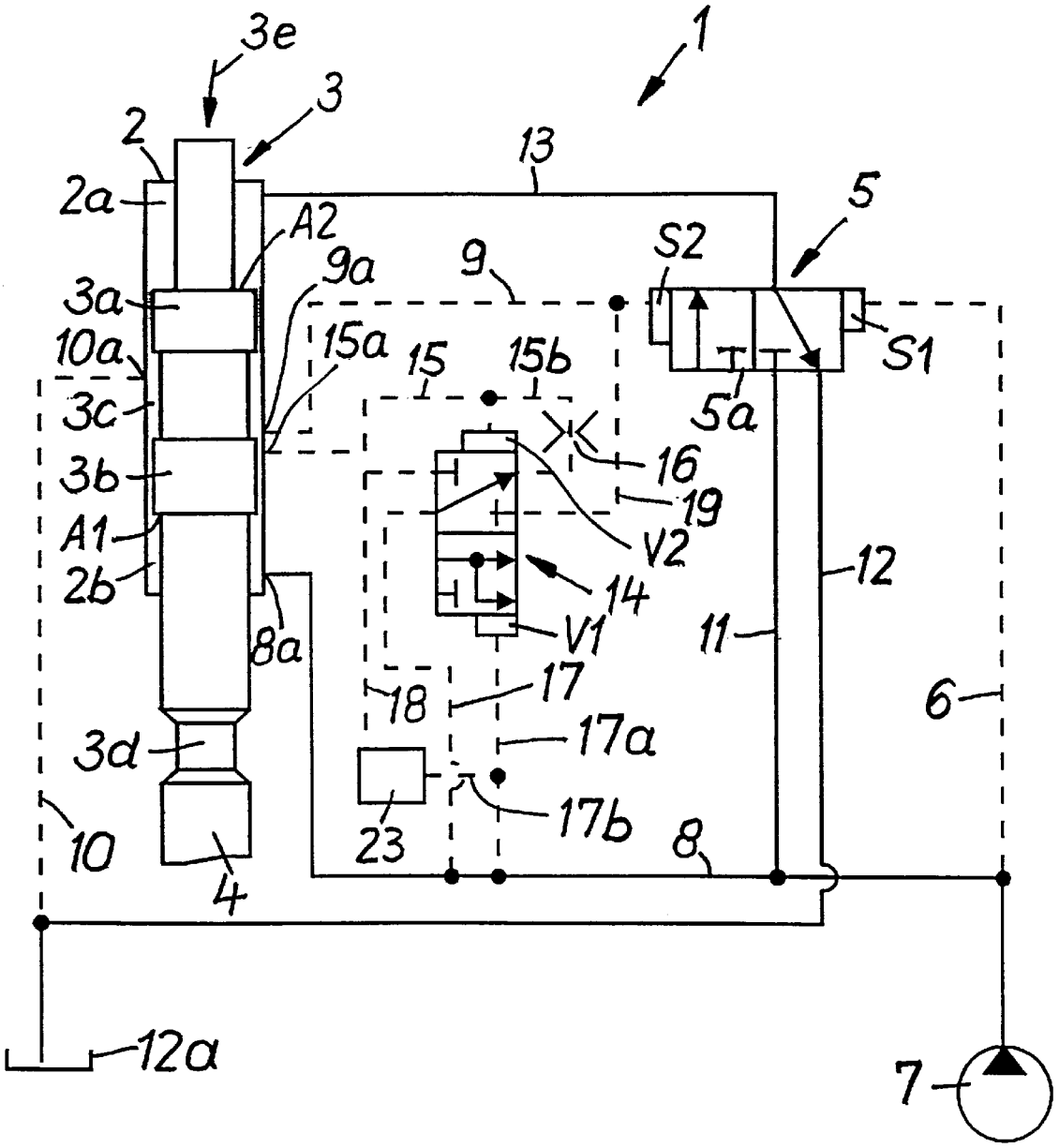
FIG. 5 is a hydraulic circuit diagram of a striker assembly as shown in FIG. 1, including a pressure controlled timing unit.

Departing, for example, from the embodiment shown in FIG. 1, the striker assembly 1 according to FIG. 5 has a short-stroke conduit 18 which is connected to the pressure conduit 8 by means of the precontrol-pressure conduit 17 with the intermediary of an only symbolically illustrated pressure-controlled timing unit 23 which has a pressure sensor, a timing member controlled by the pressure sensor and a shut-off valve controlled by the timing member. The pressure sensor converts the working pressure prevailing in the precontrol pressure conduit 17 to a control signal and dependent from the magnitude of such a signal, the timing member sets the duration during which the shut-off valve assumes its open position in which it establishes communication between the short-stroke conduit 18 and the precontrol pressure conduit 17. The pressure sensor affects the timing member in such a manner that the duration set by the timing member becomes shorter as the working pressure (system pressure) drops.

Figure 6:
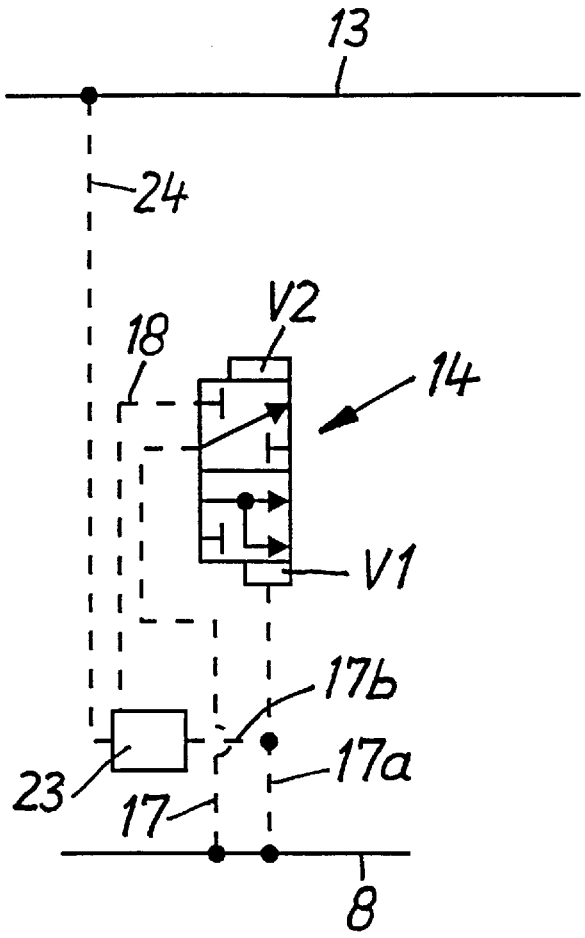
FIG. 6 is a hydraulic circuit diagram of the arrangement of FIG. 5, showing further details.

As seen in FIG. 6, the timing unit 23 is additionally connected with the alternating-pressure conduit 13 by a timing conduit 24, by means of which the timing unit 23 is placed into its inoperative state as long as the alternating pressure conduit 13 connected with the rearward cylinder chamber portion 2*a* is charged with working pressure. The timing unit 23 starts operating when a pressure drop occurs in the alternating-pressure conduit 13.

Figure 7:
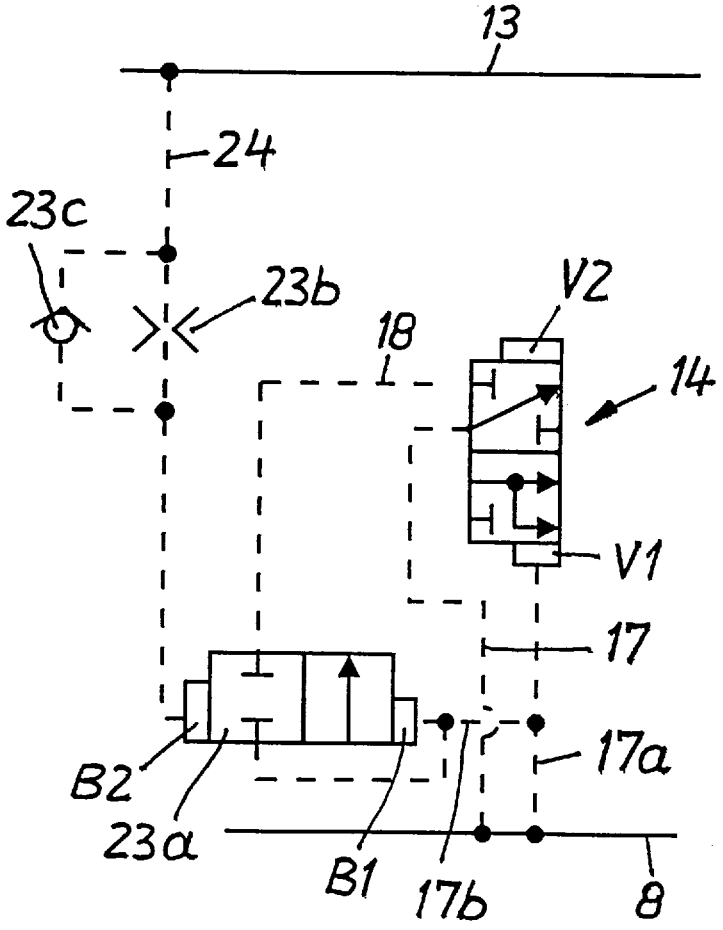
FIG. 7 is a circuit diagram showing details of the timing unit illustrated in FIGS. 5 and 6.

In the embodiment according to FIG. 7, the shut-off valve 23*a* of the timing unit 23 is for control purposes connected, on the one hand, to a resetting conduit 17*b* by means of which the smaller valve control face B1 may be charged with working pressure and, on the other hand, it is connected to the timing conduit 24 by means of its larger valve control surface B2. The resetting conduit 17*b* is connected to the pressure conduit 8 by means of the precontrol resetting conduit 17*a*. In the illustrated closed position the short-stroke conduit 18 extending from the resetting conduit 17*b* is closed towards the precontrol valve 14 by means of the shut-off valve 23*a*.

For setting a time period, the timing conduit 24 is provided with a flow resistance such as a constriction 23*b*. A check valve 23*c* is connected in parallel with the constriction 23*b* to provide for a rapid resetting of the shut-off valve 23*a* into the illustrated closed position. In the open position of the shut-off valve 23*a* the short-stroke conduit 18 is connected with the pressure conduit 8 by means of the resetting conduit 17*b* and the precontrol resetting conduit 17*a*.

In case working pressure prevails in the alternating pressure conduit 13, the shut-off valve 23*a* assumes—against the resetting force derived from the smaller valve control surface B1—the illustrated closed position in which a connection between the short-stroke conduit 18 and the pressure conduit 8 is interrupted. If the pressure decreases in the alternating-pressure conduit 13, the pressure prevailing in the timing conduit 24 also drops and, as a result, the shut-off valve 23 begins to switch over to the open position. After a time lapse caused by the constriction 23*b*, the shut-off valve 23*a* eventually assumes its open position as a result of which the short-stroke conduit 18 is charged with working pressure.

As soon as the precontrol valve 14 assumes its non-illustrated open position, the control valve 5 is moved into the working-stroke position and thus initiates the working stroke of the striker piston 3.

As soon as working pressure prevails in the alternating-pressure conduit 13 after switching over the control valve 5 (see in this connection, for example, FIG. 1) the larger valve control surface B2 of the shut-off valve 23*a* is exposed to pressure from the timing conduit 24 in the open state of the check valve 23*c*, whereby the shut-off valve 23*a* is reset into its shown initial, closed position.

The advantage of the arrangement illustrated in FIGS. 5, 6 and 7 resides in that the magnitude of the stroke executed by the striker piston 3 may be changed automatically and steplessly as a function of the working pressure. In this manner it is also possible to control externally—for example, manually or by remote control—the time period determined by the timing member and thus to take into account various conditions of operation and application.

It will be understood that the above description of the present invention is susceptible to various modifications, changes and adaptations, and the same are intended to be comprehended within the meaning and range of equivalents of the appended claims.

What is claimed is:

1. A fluid-operated striker assembly comprising (a) a working cylinder;

(b) a striker piston slidably received in said working cylinder for executing forward and return strokes; said striker piston delivering a blow to a tool bit during the forward stroke in one of a limit position and an advanced position; said advanced position being beyond said limit position in a direction of said forward stroke; said striker piston having (1) a first piston face situated in said working cylinder and being oriented such that a pressure applied thereto acts in a direction of the return stroke;

(2) a second piston face situated in said working cylinder and being oriented such that a pressure applied thereto acts in a direction of the forward stroke; said second piston face having an area greater than that of said first piston face; and (3) a circumferential groove provided in said working cylinder and positioned between said first and second piston faces;

(c) a pressure conduit in which working pressure continuously prevails; said pressure conduit having an outlet merging into said working cylinder such as to continuously charge said first piston face with the working pressure;

(d) a depressurized return conduit having an outlet merging into said working cylinder;

(e) a control valve including a control plunger having a working-stroke position in which said second piston face is charged with working pressure from said pressure conduit through said control valve and a return-stroke position in which said second piston face is depressurized through said control valve via said return conduit; said control plunger including (1) a first plunger face continuously charged with working pressure for urging said control plunger into said return-stroke position; and (2) a second plunger face having an area greater than that of said first plunger face and being periodically and alternatingly charged with working pressure from said pressure conduit and depressurized via said return conduit through said circumferential groove for causing said control plunger to move into said working-stroke position and into said return-stroke position, respectively;

(f) a short-stroke conduit connected to said working cylinder;

(g) an additional conduit being in fluid communication with said second plunger face of said control plunger; and (h) a precontrol arrangement having a precontrol conduit; said short-stroke conduit being connected to said precontrol arrangement; said precontrol arrangement having a closed position assumed as long as said striker piston does not exceed said limit position in the direction of said forward stroke; said additional conduit being closed in said closed position of said precontrol arrangement; said precontrol arrangement having an open position assumed under an effect of pressure conditions in said precontrol conduit when said striker piston assumes said advanced position; in said open position said precontrol arrangement establishes fluid communication between said precontrol conduit and said additional conduit; in said open position of said precontrol arrangement said short-stroke conduit and said additional conduit being placed under working pressure during execution of a return stroke by said striker piston immediately after assuming said advanced position, whereby said second plunger face is charged with working pressure from said short-stroke conduit and said additional conduit to move said control plunger prematurely into said working-stroke position.

2. The fluid-operated striker assembly as defined in claim 1, further comprising a switch-over conduit being in fluid communication with said second plunger face of said control plunger; said switch-over conduit having an outlet merging into said cylinder at a location where said outlet is in fluid communication with said circumferential groove which is in a depressurized state as long as said striker piston does not exceed said limit position; said precontrol conduit having an outlet merging into said cylinder at a location behind said outlet of said switch-over conduit as viewed in a direction of said forward stroke.

3. The fluid-operated striker assembly as defined in claim 1, wherein said short-stroke conduit and said precontrol conduit have respective outlets merging into said cylinder such that said outlet of said short-stroke conduit is located behind said outlet of said precontrol conduit as viewed in the direction of said forward stroke of said striker piston.

4. The fluid-operated striker assembly as defined in claim 1, wherein said precontrol arrangement is constituted by a precontrol valve having said closed and open positions; further comprising resetting means for urging said precontrol valve into said open position; said precontrol valve having a setting face chargeable with a setting force for moving said precontrol valve into said closed position against a resetting force exerted by said resetting means; said precontrol conduit being in fluid communication with said setting face, whereby said setting face is charged by said setting force from said precontrol conduit and said additional conduit when working pressure periodically prevails in said precontrol conduit.

5. The fluid-operated striker assembly as defined in claim 4, further comprising a mechanical resetting means for urging said precontrol valve into said open position.

6. The fluid-operated striker assembly as defined in claim 4, further comprising (a) an alternating-pressure conduit connected to said control valve to be charged with working pressure or being depressurized dependent on whether said control valve is in said working-stroke position or in said return-stroke position, respectively; said alternating-pressure conduit being connected to said cylinder and being in a continuous fluid communication with said second piston face of said striker piston; and (b) a pressure-controlled timing unit contained in said short-stroke conduit; said short-stroke conduit being connected with an input of said precontrol valve; said timing unit remaining inoperative as long as working pressure prevails in said alternating-pressure conduit.

7. The fluid-operated striker assembly as defined in claim 4, further comprising a precontrol branch conduit extending from said precontrol conduit; said precontrol branch conduit being connected to an output of said precontrol valve and being charged with working pressure in said closed position of said precontrol valve.

8. The fluid-operated striker assembly as defined in claim 7, wherein said short-stroke conduit is in simultaneous fluid communication with said additional conduit and said precontrol branch conduit in said open position of said precontrol valve.

9. The fluid-operated striker assembly as defined in claim 7, further comprising a precontrol-pressure conduit extending from said pressure conduit and being connected to an input of said precontrol valve such that in said closed position of said precontrol valve said precontrol-pressure conduit is in fluid communication with said precontrol branch conduit.

10. The fluid-operated striker assembly as defined in claim 9, further comprising (a) an alternating-pressure conduit connected to said control valve to be charged with working pressure or being depressurized dependent on whether said control valve is in said working-stroke position or in said return-stroke position, respectively; said alternating-pressure conduit being connected to said cylinder and being in a continuous fluid communication with said second piston face of said striker piston; and (b) a switching conduit connecting an output of said precontrol valve with said alternating-pressure conduit; in said closed position of said precontrol valve fluid communication being maintained solely between said precontrol pressure conduit and said precontrol branch conduit while maintaining closed said short-stroke conduit, said additional conduit and said switching conduit; in said open position said precontrol valve maintaining, through said precontrol valve, fluid communication between said precontrol branch conduit and said switching conduit, further maintaining, through said precontrol valve, fluid communication between said short-stroke conduit and said additional conduit and maintaining closed said precontrol pressure valve.

11. The fluid-operated striker assembly as defined in claim 9, further comprising (a) an alternating-pressure conduit connected to said control valve to be charged with working pressure or being depressurized dependent on whether said control valve is in said working-stroke position or in said return-stroke position, respectively; said alternating-pressure conduit being connected to said cylinder and being in a continuous fluid communication with said second piston face of said striker piston; and (b) a pressure-controlled timing unit connected in said short-stroke conduit; said short-stroke conduit being connected with an input of said precontrol valve; said timing unit remaining inoperative as long as working pressure prevails in said alternating-pressure conduit; said timing unit including a pressure sensor, a timing member controlled by said pressure sensor and a shut-off valve controlled by said timing member; said pressure sensor being connected to said precontrol-pressure conduit for converting the working pressure therein to a control signal having a magnitude; in said timing member a period being set as a function of said magnitude of said control signal; during said period said shut-off valve being in an open position.

12. The fluid-operated striker assembly as defined in claim 4, wherein said setting face is a first setting face; further wherein said precontrol valve has a second setting face exposed to the working pressure from said pressure conduit for urging said precontrol valve into said open position; said second setting face forming part of said resetting means; said first setting face having an area greater than that of said second setting face.

13. The fluid-operated striker assembly as defined in claim 12, further comprising a mechanical resetting element connected parallel to said second setting face; a combined resetting force composed of the force exerted by said mechanical resetting element and the working pressure applied to said second setting face being smaller than a counterforce derived from the working pressure applied to said first setting face.

14. The fluid-operated striker assembly as defined in claim 12, wherein said resetting means further comprises a precontrol-resetting conduit maintaining fluid communication between said pressure conduit and said second setting face of said precontrol valve.

15. A fluid-operated striker assembly comprising (a) a working cylinder;

(b) a striker piston slidably received in said working cylinder for executing working and return strokes; said striker piston delivering a blow to a tool bit during the working stroke in one of a limit position and an advanced position; said advanced position being beyond said limit position in a direction of said working stroke;

(c) control means for applying alternating fluid pressure to said striker piston to execute the working and return strokes; and (d) precontrol means for affecting said control means dependent on whether said striker piston has exceeded said limit position; said precontrol means including (1) first means for causing said control means to operate said striker piston with a normal working stroke as long as said striker piston delivers a blow to said tool bit in said limit position; and (2) second means for causing said control means to operate said striker piston with a short working stroke as long as said striker piston delivers a blow to said tool bit in said advanced position; said short working stroke having a length less than that of said normal working stroke.

* * * * *